United States Patent [19]

Baranescu

[11] Patent Number: 4,705,010

[45] Date of Patent: Nov. 10, 1987

[54] INJECTION SYSTEM WITH STRATIFIED FUEL CHARGE

[76] Inventor: George S. Baranescu, 5316 Howard Ave., Western Springs, Ill. 60558

[21] Appl. No.: 526,273

[22] Filed: Aug. 24, 1983

[30] Foreign Application Priority Data

Aug. 31, 1982 [GB] United Kingdom ..... 8224793

[51] Int. Cl.[4] ..... F02M 39/00

[52] U.S. Cl. ..... 123/575; 123/300

[58] Field of Search ..... 123/575–578, 123/500, 501, 299, 300

[56] References Cited

U.S. PATENT DOCUMENTS

| | | | |
|---|---|---|---|
| 1,365,301 | 1/1921 | Brooks | 123/300 |
| 3,308,794 | 3/1967 | Bailey | 123/575 |
| 3,749,097 | 7/1973 | Grow | 123/575 |
| 4,392,466 | 7/1983 | Mowbray | 123/299 |
| 4,471,744 | 9/1984 | Holtz | 123/575 |
| 4,481,921 | 11/1984 | Tsukahara | 123/300 |
| 4,505,244 | 3/1985 | Smith | 123/575 |

*Primary Examiner*—Carl Stuart Miller

[57] ABSTRACT

A high pressure fuel injection system having the capability to inject periodically one or more fuels, stratified before injection into injector in a selected sequence, and in amounts controllable from cycle to cycle. The injection pump (6) operates with a fuel having high self-ignition ability. During consecutive injections the high pressure line (8) is connected to fuel tank (1) of the injection pump. A source of fuel (11) delivers a degraded fuel into nozzle (17) during consecutive injections. Another source of fuel (41), which delivers into injector the kind of fuel used by the injection pump, allows a selected stratification of the two fuels, or the formation of a blend of the two fuels. Each fuel source delivers the respective fuel at controllable pressure and temperature, in controllable amount, and with controllable timing. The fuel injection starts and ends with pilots of the fuel having high self-ignition ability. A pressure intensifier increases the injection pressure while allowing the fuel delivery into nozzle. Diesel engines provided with this injection system can operate with a large variety of fuels.

14 Claims, 7 Drawing Figures

INJECTION SYSTEM WITH STRATIFIED FUEL CHARGE

The invention relates to a high pressure fuel injection system for diesel engines, which allows the engine operation with a large variety of fuels.

The existing methods for achieving fuel tolerance of internal combustion engines are based on two concepts: (1) single fuel operation which uses one fuel at a time, and (2) dual fuel operation which uses two fuels at a time, one of the fuels, which has high self-ignition ability, igniting the other fuel which has low self-ignition ability.

Single fuel operation is achieved by several methods like spark assisted engine, ignition on hot surface, the control of air parameters at the beginning of fuel injection, and the catalitic engine. Better results have been obtained with spark assisted engine. For various reasons none of these methods is able to ensure a large fuel tolerance of the engine.

Dual fuel operation is achieved by : (1) fumigation of the fuel with low self-ignition ability during the intake stroke and its later ignition by the fuel with high self-ignition ability; (2) injection of a blend of the two fuels, the blend being used either at any operating regime, or at selected operating regimes as shown in United Kingdom Pat. Nos. 953348 and 1150043; (3) injection of the two fuels consecutively through the same injector, as shown in United Kingdom Pat. No. 260584; (4) injection of the two fuels by their own injection system. Only the last method has the potential for achieving fuel tolerance of diesel engine; however, this method cannot ensure the engine operation with fuels which are not tolerated by the injection system.

The invention as claimed ensures the fuel tolerance of diesel engine by using two fuels, in a way which remedies the drawbacks of the existing methods based on dual fuel operation. Between consecutive injections the fuel with low self-ignition ability, called further second fuel, is delivered into injector in controllable amount and at selected temperature. Here the second fuel charge stratifies among two or several amounts of fuel with high self-ignition ability, called further first fuel. The injection pump operates with first fuel only. When this pump delivers fuel into the high pressure line of the injection system, the injector opens, and the two fuels are injected in the sequence in which they have been stratified, starting and ending with amounts of first fuel. Further, the amounts of first fuel injected in stratified mode are called pilots.

The injection system has also the capability to achieve and inject blends of two fuels, and to modify the blend composition. In this case the injection can be performed either with blend only, or with blend preceded and followed by pilots.

To allow the fuel delivery into nozzle, the high pressure line of the injection system is connected to the tank of first fuel, between consecutive injections.

Further objects and advantages of the invention, and the manner in which it is carried into practice, are set forth in the following specification, wherein the invention is described in further detail by reference to the accompanying drawing.

Figure 1:
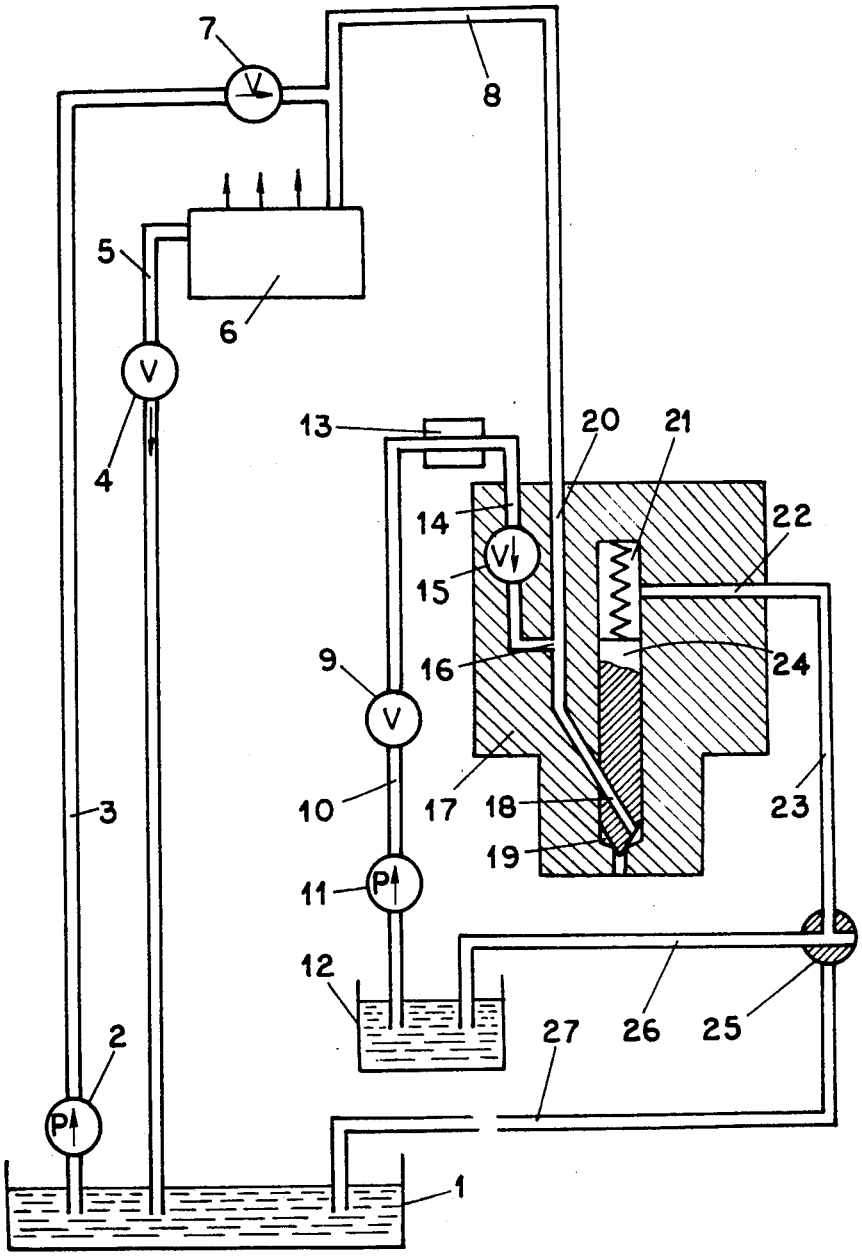
FIG. 1 is a schematic of an embodiment of the injection system with stratified fuel charge, which ensures the fuel injection in the sequence: initial pilot—second fuel charge—last pilot, the amount of initial pilot being constant.

In the embodiment of FIG. 1 the high pressure channel 20 of the injector 17 is connected to the high pressure line 8, and to the injector pressure chamber 19 through channel 18 of injector needle 24; to maintain the permanent connection of channels 18 and 20 the injector needle rotation is restricted. The injector includes the additional channel 14, provided with the one-way check valve 15, and connected to channel 20. A low pressure fuel delivery system, including the pump 11, line 10, valve 9 and heater 13, can deliver second fuel from tank 12 into channel 14. Between consecutive injections the high pressure line 8 is connected to the tank 1 of first fuel, via injection pump 6, line 5, and relief valve 4. An auxiliary source of first fuel, including the pump 2, line 3, and one-way check valve 7, can deliver first fuel from tank 1 into high pressure line 8, when the pressure in this line is lower than the pressure in line 3. The pressure in line 3 is higher than the opening pressure of the relief valve 4, but lower than the pressure in line 10.

The injection system operates a follows. At the end of injection the high pressure line 8, channels 20 and 18, and injector pressure chamber 19 are filled with first fuel, and channel 14 is filled with second fuel. At a selected moment between consecutive injections, when lines 8 and 5 are connected, valve 9 is opened. As a result second fuel from tank 12, heated by heater 13, is delivered into nozzle 17, where it stratifies in channel 20, starting from port 16. An equal volume of first fuel from channel 20 is flushed into line 8, which causes a corresponding discharge of line 5 into tank 1.

When the necessary amount of second fuel has been accumulated into channel 20, valve 9 is closed, which generates the closing of one-way check valve 15. In this moment the fuel stratification in the injector is: first fuel from the injector pressure chamber 19 to the port 16; second fuel from port 16 to a cross section of channel 20, according to the amount of second fuel delivered into injector; first fuel from this cross section of channel 20 to high pressure line 8.

Fuel injection is determined by the pump 6. Before the start of injection the connection between lines 8 and 5 is closed. When the injection pump 6 delivers first fuel into line 8, injector 17 opens. Initially, the first fuel downstream from port 16 is injected; this is the initial pilot. Then follows the injection of the second fuel charge. The injection ends with an amount of first fuel, which is the last pilot; to achieve this pilot the amount of first fuel delivered into line 8 by the injection pump 6 should be larger than the sum of the initial pilot and the second fuel charge.

When the injection pump ends the fuel delivery into line 8, the connection between lines 8 and 5 is opened. Consequently line 8 discharges into tank 1, which assures a fast closing of the injector needle. When the pressure in line 8 becomes lower than the pressure in line 3, the one-way check valve 7 opens, and first fuel flows into line 8, filling the eventual voids generated by the injection process, and flushing into tank 1 the fuel of line 8 between one-way check valve 7 and injection pump 6, as well as a part of the fuel of the injection pump sump.

The second fuel charge can be varied by changing the opening time of valve 9, the flow area of this valve, or the fuel pressure in line 10. The valve 9 can be of any type. More advantageous is the electromagnetic type, since it is easier electronically programmable, which allows the injection of the maximum amount of second fuel tolerated by the engine at each operating regime.

The embodiment of FIG. 1 achieves a constant initial pilot. The last pilot can be varied by changing the amount of first fuel delivered by the injection pump 6 into high pressure line 8.

If the control of valve 9 is disconnected the injection system delivers first fuel only. Therefore the engine can easily switch from dual fuel operation to first fuel operation, and vice-versa.

The connection of lines 8 and 5 between consecutive injections can be also achieved through a derivation provided with a valve.

To operate in stratified fuel mode the injector should prevent the mixing of the two fuels. For this purpose the injector design in the stratification region should avoid grooves or other geometries which favor the mixing of the two fuels. Also the injector pressure chamber 19 should be very small. As an example, in FIG. 1 chamber 19 is delimited by the conical tip of the injector needle 24, by the conical seat of this needle, and by the injector body 17. If the injector size allows the direct connection of channel 20 to chamber 19, channel 18 is not necessary.

The fuel leakage between the injector needle and injector body is collected in chamber 21, and drained into tank 12 via channel 22, line 23, three way valve 25, and line 26, when the injection system operates in dual fuel mode, or into tank 1 via line 27 when the injection system operates with first fuel only.

Figure 2:
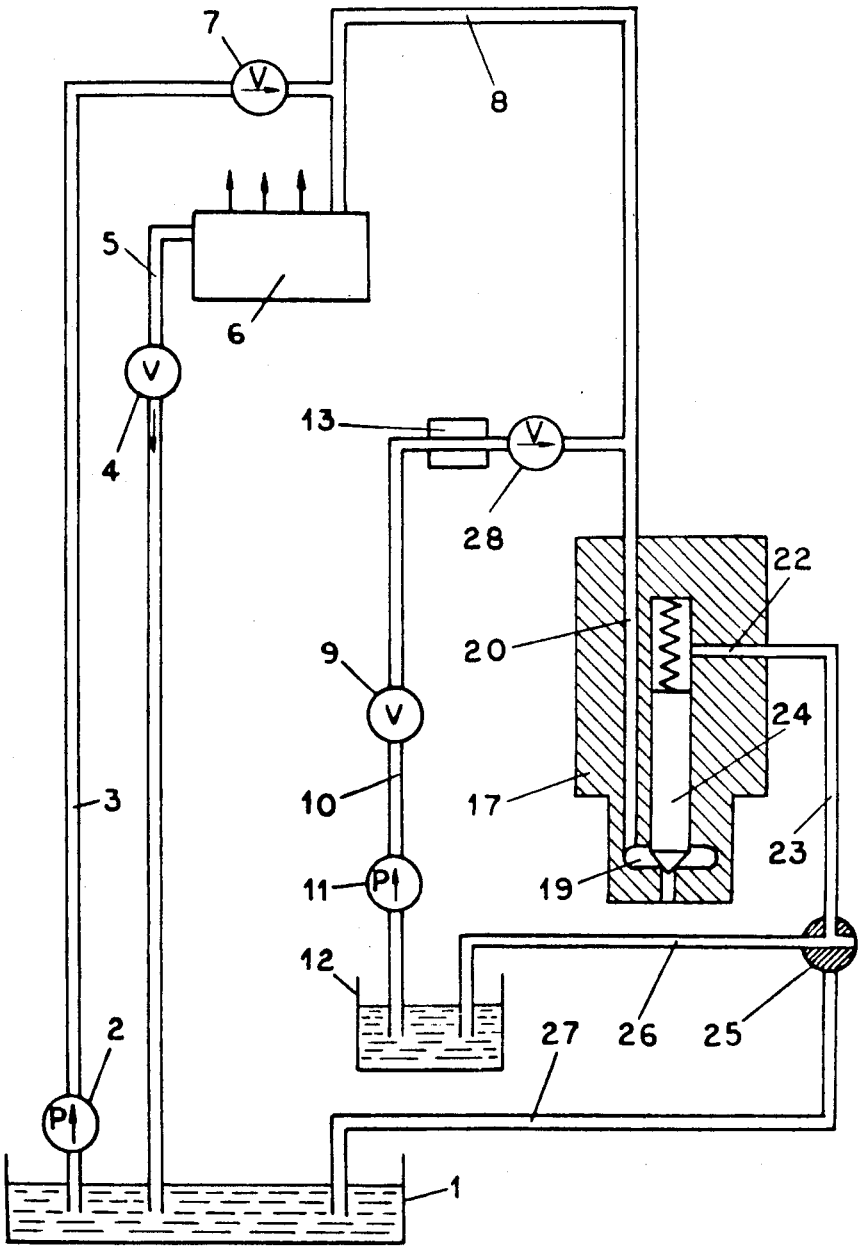
FIG. 2 is a schematic of an embodiment of the injection system with stratified fuel charge, which has the capability to achieve and inject blends of two fuels, and to modify the blend composition.

With a conventional injector the injection system of FIG. 1 can inject blends of two fuels, the blend composition being fast variable. For this purpose the delivery system of the second fuel is connected to line 8 via one-way check valve 28, as shown in FIG. 2. The second fuel charge stratifies into line 8, and mixes with first fuel on its way to chamber 19, and especially in this chamber.

The connection of lines 8 and 5 through injection pump 6, between consecutive injections, is achieved according to the injection pump type.

Figure 3:
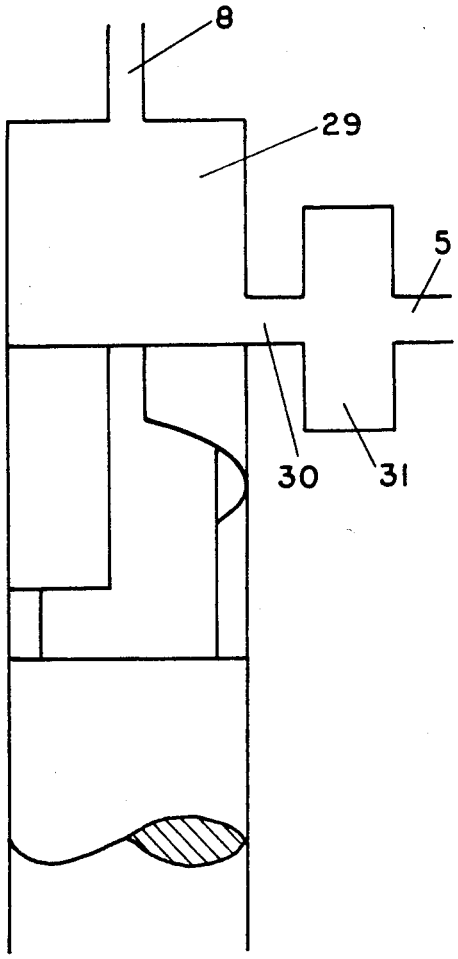
FIG. 3 shows in a schematic way a solution for connecting the high pressure line to the tank of first fuel during consecutive injections, through an individual or in-line injection pump.

In the case of injection pumps having a pumping element for each cylinder the connection of lines 8 and 5 between consecutive injections can be achieved for example by removing the pump delivery valve (FIG. 3). Lines 8 and 5 are connected via barrel 29, channel 30, and sump 31, as long as barrel 29 is in connection with channel 30.

Figure 4:
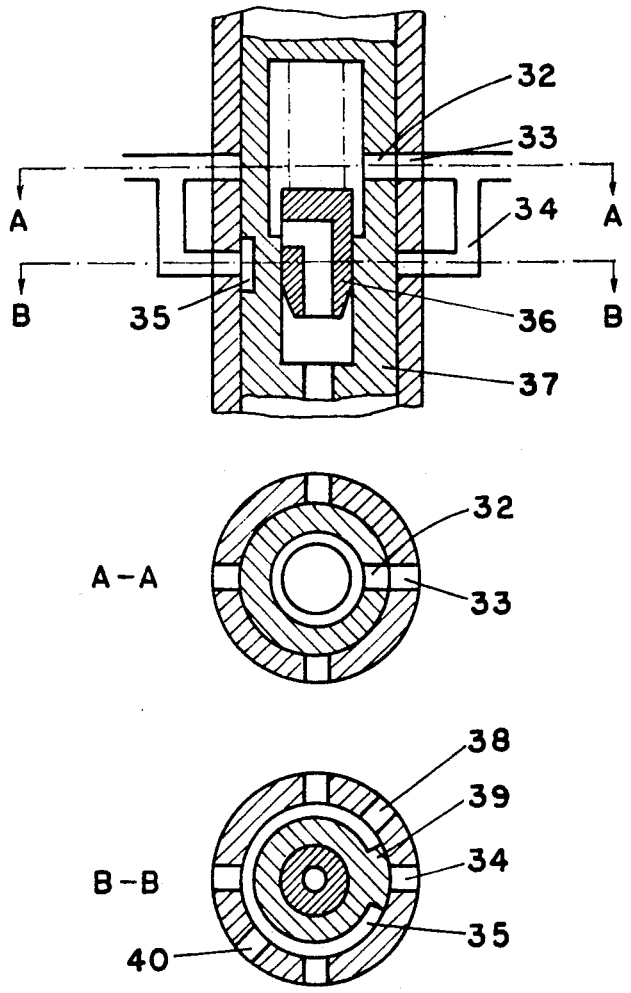
FIG. 4 is a schematic of a solution for connecting the high pressure line to the tank of first fuel during consecutive injections, through an injection pump of separate distributor type.

In the case of injection pumps of separate rotary distributor type the connection between lines 8 and 5 can be achieved for example using the solution schematically shown in FIG. 4. In this figure only the part of the distributor 37 close to the delivery valve 36, and to the radial channel 32 is represented. An injection pump for a four cylinder engine was considered. The following description refers only to the connections for one engine cylinder.

The high pressure line 8 is connected to the distributor 37 via channel 33. The groove 35, which extends only partially around the distributor 37, is connected to line 5 via channels 38 and 40, and to channel 33 via channel 34. The nose 39 of the distributor closes channel 34 before the beginning of the fuel delivery into channel 33 which allows the subsequent fuel injection. At the end of the fuel delivery into channel 33, channel 34 is opened, which connects the high pressure line to the tank of first fuel via channels 33 and 34, groove 35, and channels 38 and 40.

The above described solution for achieving the connection between lines 8 and 5 between consecutive injections can be used for the type of injection pumps wherein the pump piston is also a distributor.

To avoid the modification of the injection pump, a distributor as a separate part can be used for connecting lines 8 and 5 between consecutive injections. The distributor should be designed to achieve the connections as described above.

Figure 5:
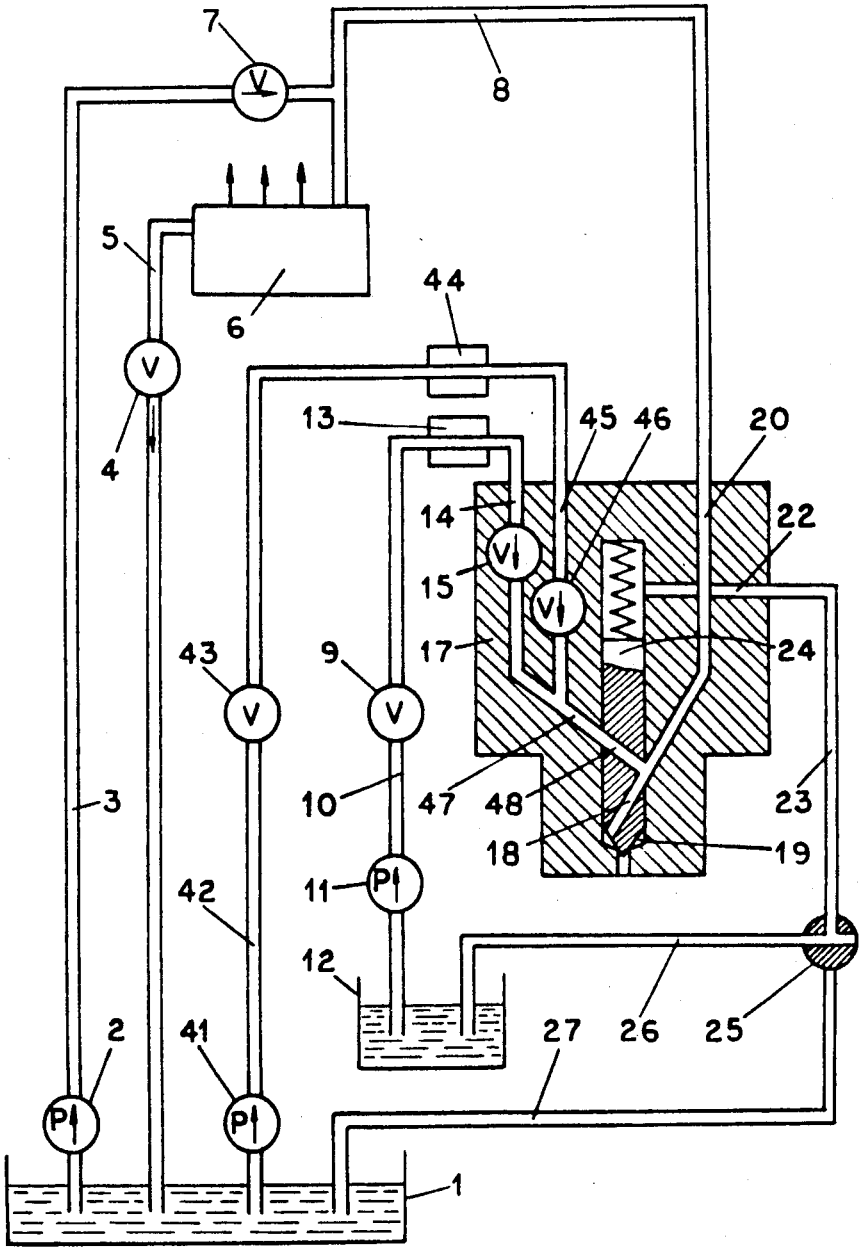
FIG. 5 is a schematic of an embodiment of the injection system with stratified fuel charge, which achieves the fuel charge stratification with two or several pilots of variable amount.

FIG. 5 shows an embodiment of the injection system with stratified fuel charge having the capability to modify the initial pilot, to stratify the second fuel charge among several pilots, and to inject the second fuel charge either in stratified mode, of blended with first fuel.

The injector of FIG. 5 has a second additional channel 45, provided with one-way check valve 46. Channels 14 and 45 are permanently connected to channel 20 via channels 47 and 48; to maintain this connection the rotation of nozzle needle is restricted. A main source of first fuel including the pump 41, line 42, valve 43 and eventually the heater 44 can deliver first fuel from tank 1 into channel 45.

The fuel stratification occurs as follows. At a selected moment when lines 8 and 5 are connected, valve 9 is opened for a period of time which allows the second fuel charge to flow into channels 47, 48 eventually into channel 20. Then valve 43 is opened. First fuel penetrates into channel 47, pushing the second fuel charge into channel 20. Valve 43 is closed when the amount of first fuel which has penetrated into channel 20, together with the amount of first fuel which has remained in channel 18 and pressure chamber 19 from the previous injection, is the necessary amount of initial pilot. When the injection pump 6 delivers first fuel into line 8, the injector opens, and the injection occurs in the sequence: initial pilot—second fuel charge—last pilot.

The size of initial pilot can be modified starting from the amount of first fuel accumulated in channel 18 and pressure chamber 19, by modifying the timing of valve 43. The range of variation is increased if channel 18 is shorter.

If valves 9 and 43 are alternately opened several times, the second fuel charge stratifies among several pilots. If these valves have the same timing, the two fuels delivered into nozzle mix with each other; in this case the system injects a blend of the two fuels preceded and followed by pilots.

By disconnecting the control of valves 9 and 43 the nozzle delivers first fuel only. Therefore, the injection system of FIG. 5 can also switch fast and easy from dual fuel operation to first fuel operation and vice-versa.

To simplify the injector design, the second fuel can be delivered into channel 45 upstream from the one-way check valve 46. In this case the one-way check valve 15 can be eliminated.

The fuel atomization can be improved by increasing the injection pressure with a pressure intensifier. Any type of pressure intensifier can be used; some modifications are necessary to meet the specific requirements of fuel charge stratification.

Figure 6:
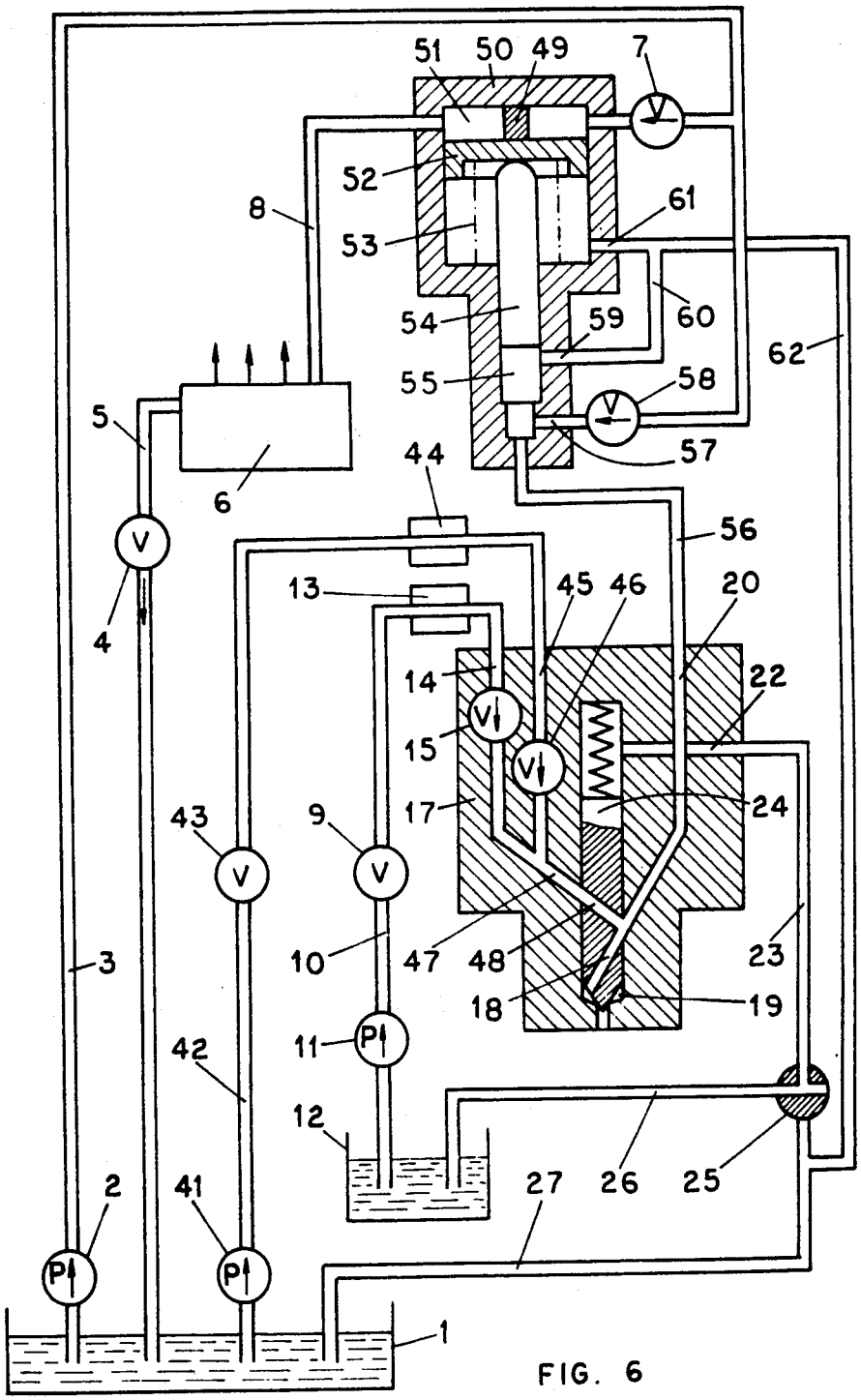
FIG. 6 is a schematic of an embodiment of the injection system with stratified fuel charge provided with a pressure intensifier which allows the fuel delivery into nozzle.

FIG. 6 illustrates the required developments of the pressure intensifier. The injection system schematically shown in this figure is that of FIG. 5, provided with the pressure intensifier 50. Between consecutive injections lines 8 and 5 are connected as previously shown. Channel 20 is connected to the first fuel tank 1 via line 56, barrel 55, channel 59, and lines 60, 62, and 27; this connection allows the fuel delivery into nozzle. Barrels 51 and 55 are connected to line 3 respectively through one-way check valves 7 and 58, which ensures the flushing of first fuel from these barrels between consecutive injections. When the injection pump 6 delivers first fuel into line 8, pistons 52 and 54 move downwards, the one-way check valves 7 and 58 close, and—after the closing of channel 59 by piston 54—the fuel charge is injected at a higher pressure than that of line 8. At the end of fuel delivery into line 8 pistons 52 and 54 move upwards, until the stop 49 is reached. The leakage between the two pistons and the body 50 are collected in the chamber of the spring 53, and drained into tank 1 via channel 61, and lines 62 and 27.

Figure 7:
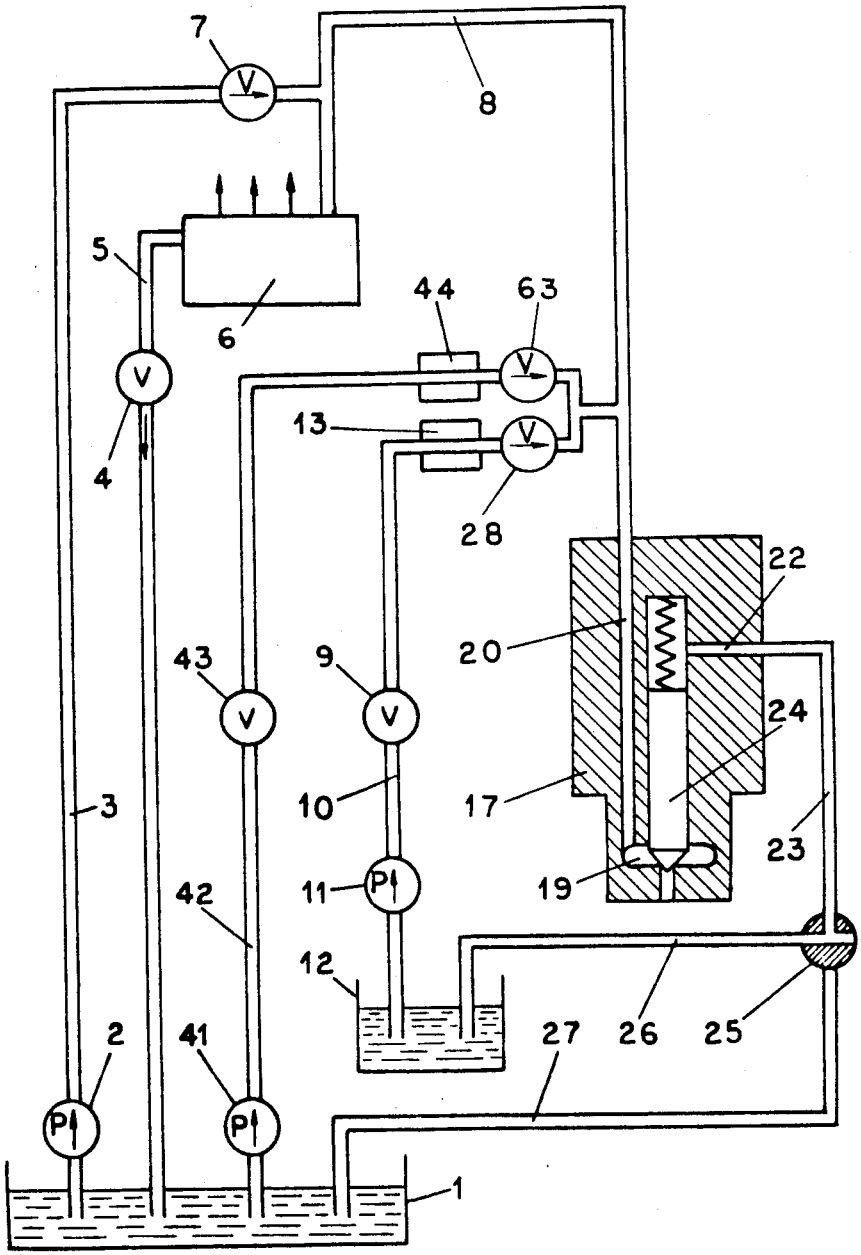
FIG. 7 is a schematic of an embodiment of the injection system with stratified fuel charge, which has the capability to achieve and inject blends of two fuels, and to modify the blend composition in controllable manner.

With a conventional injector the injection system of FIG. 5 can deliver blends of the two fuels, the blend composition being better controllable than in the case of the injection system of FIG. 2. For this purpose lines 10 and 42 are connected to line 8 respectively through one-way check valves 28 and 63, as shown in FIG. 7.

The injection system with stratified fuel charge, according to the invention has several advantages. It allows the operation of diesel engine with a large variety of fuels, since the combustion of the pilots creates in combustion chamber an environment which ensures ignition and combustion of the second fuel whatever are the characteristics of this fuel. The injection of the two fuels being achieved through the same nozzle, both fuels are injected from the most favorable location for fuel-air mixture formation and for combustion development. The fuel charge composition can be modified from cycle to cycle for the embodiments of FIGS. 1, 5, and 6, or within a few cycles, for the embodiments of FIGS. 2 and 7, which allows its optimization at any operating regime of the engine. The second fuel is stratified in a region of the injector where it is not in contact with moving parts, which allows a significant heating of the second fuel. The injection always ends on first fuel which flushes the second fuel from the injector holes, thus preventing the formation of carbon deposits in these holes when heavy fuels are used. The injection pump operates with first fuel only, and the injector needle moves only in first fuel; due to these circumstances the injection system is insensitive to the lubricating property of the second fuel. The manufacturing of the injection system with stratified fuel charge does not require new technologies, or a noticeable factory retooling.

The foregoing relates to preferred exemplary embodiment of the invention, it being understood that other embodiments and variants are possible within the spirit and scope of the invention.

What is claimed is:

1. A high pressure fuel injection system including an injection pump connected by means with at least one nozzle, said nozzle including a high pressure channel connected to the injection pump by said means, a pressure chamber connected with said high pressure channel and with the delivery channel of the nozzle, said delivery channel being closed by means between consecutive injections, said high pressure fuel injection system including also two fuel tanks, one tank to which the injection pump is connected containing a fuel, called first fuel, whose characteristics are suitable for the operation of a diesel engine, the other tank containing a fuel, called second fuel, whose characteristics are not suitable for the operation of a diesel engine, the high pressure fuel injection system having the capability to inject periodically first fuel together with second fuel, said high pressure fuel injection system being characterized by the capacity to stratify the second fuel charge between portions of first fuel called pilots, the stratification occurring between consecutive injections in a region of the high pressure channel, said region where the stratification of the two fuels occurs being so selected that the second fuel charge is injected in the next cycle interspersed with pilots of first fuel, starting and ending with pilots of first fuel, said high pressure fuel injection system being also characterized by the capacity to switch from dual fuel operation to the operation with first fuel only and vice-versa from cycle to cycle, these capacities being achieved by several means including a nozzle provided with two additional channels, called the first and the second additional channels, said additional channels being connected with said high pressure channel close to said pressure chamber, each additional channel being provided with a one-way check valve, said nozzle having a pressure chamber of very small volume, and a configuration of the high pressure channel which prevent the mixing between the second fuel charge and the pilots of first fuel during their stratification as well as during their injection, a source of second fuel which delivers second fuel from the respective tank into said second additional channel, the second fuel being delivered between consecutive injections at controllable pressure and temperature, in controllable amount, and with controllable timing, said source of second fuel being electronically programmable, a main source of first fuel which delivers first fuel from the respective tank into said first additional channel, the first fuel being delivered between consecutive injections at controllable pressure and temperature, in controllable amount, and with controllable timing, said main source of first fuel being electronically programmable, means which connect the high pressure section of the injection system with the tank of first fuel between consecutive injections for a period between selected instants of the cycle, means which ensure a selected pressure in the high pressure section of the injection system between consecutive injections, a drain provided with means which direct the fuel leakages, either to the tank of second fuel or to the tank of first fuel, dependent upon the operation of the injection system with first fuel and second fuel, or with first fuel only.

2. A high pressure fuel injection system as defined in claim 1, wherein the pressure chamber of the nozzle is delimited by the nozzle needle tip, the nozzle needle seat, and the nozzle body.

3. A high pressure fuel injection system as defined in claim 2, wherein said high pressure channel is directly connected to said pressure chamber.

4. A high pressure fuel injection system as defined in claim 2, wherein said high pressure channel is connected to said pressure chamber through a channel located in nozzle needle.

5. A high pressure fuel injection system as defined in claim 1, wherein said first additional channel, its one-way check valve, and said main source of first fuel are eliminated.

6. A high pressure fuel injection system as defined in claim 5, wherein the pressure chamber of the nozzle is delimited by the nozzle needle tip, the nozzle needle seat, and the nozzle body.

7. A high pressure fuel injection system as defined in claim 6, wherein said high pressure channel is directly connected to said pressure chamber.

8. A high pressure fuel injection system as defined in claim 6, wherein said high pressure channel is connected to said pressure chamber through a channel located in nozzle needle.

9. A high pressure fuel injection system as defined in any one of the claims 3, 4, 7 or 8, wherein said injection pump is of the type having a pumping element for each nozzle, said connection between the high pressure section of the injection system and the tank of first fuel being achieved through the injection pump, and opened or closed at selected moments by the plunger of the injection pump.

10. A high pressure fuel injection system as defined in any one of the claims 3, 4, 7 or 8, wherein said injection pump is of separate distributor type, said connection between the high pressure section of the injection system and the tank of first fuel being achieved through said injection pump, and opened or closed at selected moments by the distributor of the injection pump.

11. A high pressure fuel injection system as defined in any one of the claims 3, 4, 7 or 8, wherein said injection pump is of plunger—distributor type, said connection between the high pressure section of the injection system and the tank of first fuel being achieved through said injection pump, and opened or closed at selected moments by the plunger distributor of the injection pump.

12. A high pressure fuel injection system as defined in claim 9, including a pressure intensifier located on the connection between the injection pump and the nozzle, the large barrel of said pressure intensifier being connected with the injection pump, also connected with an auxiliary source of first fuel through a one-way check valve, the small barrel of said pressure intensifier being in open connection with the high pressure channel of the nozzle, also connected with said auxiliary source of first fuel through a one way check valve, as well as with the drain of first fuel through a channel which is closed and opened by the plunger of the small barrel.

13. A high pressure fuel injection system as defined in claim 10, including a pressure intensifier located on the connection between the injection pump and the nozzle, the large barrel of said pressure intensifier being connected with the injection pump, also connected with an auxiliary source of first fuel through a one-way check valve, the small barrel of said pressure intensifier being in open connection with the high pressure channel of the nozzle, also connected with said auxiliary source of first fuel through a one way check valve, as well as with the drain of first fuel through a channel which is closed and opened by the plunger of the small barrel.

14. A high pressure fuel injection system as defined in claim 11, including a pressure intensifier located on the connection between the injection pump and the nozzle, the large barrel of said pressure intensifier being connected with the injection pump, also connected with an auxiliary source of first fuel through a one-way check valve, the small barrel of said pressure intensifier being in open connection with the high pressure channel of the nozzle, also connected with said auxiliary source of first fuel through a one way check valve, as well as with the drain of first fuel through a channel which is closed and opened by the plunger of the small barrel.

* * * * *